US006270881B1

(12) United States Patent
Yuasa et al.

(10) Patent No.: US 6,270,881 B1
(45) **Date of Patent: *Aug. 7, 2001**

(54) RECORDING MEDIUM FOR INK-JET

(75) Inventors: Toshiya Yuasa, Kawasaki; Motokazu Kobayashi, Yokohama, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/151,725

(22) Filed: Sep. 11, 1998

(51) Int. Cl.[7] ..... B41M 5/00

(52) U.S. Cl. ..... 428/211; 428/195; 428/328; 428/329; 428/537.5

(58) Field of Search ..... 428/195, 532, 428/537.5, 329, 211, 328

(56) References Cited

U.S. PATENT DOCUMENTS 5,320,902 * 6/1994 Malhotta et al. .
5,908,728 * 6/1999 Sakaki et al. .

FOREIGN PATENT DOCUMENTS 55-51583 4/1980 (JP) .
56-84992 7/1981 (JP) .
56-86789 7/1981 (JP) .
60-67190 4/1985 (JP) .
61-134290 6/1986 (JP) .
2-88286 3/1990 (JP) .
2-92576 4/1990 (JP) .
6-32046 2/1994 (JP) .
6-262868 9/1994 (JP) .
7-1833 1/1995 (JP) .
7-89221 4/1995 (JP) .

OTHER PUBLICATIONS

J. Roček, et al., "Effect of Precipitation and Aging on Porous Structure of Aluminum Hydroxide. I. Statistical Treatment of Experimental Data", Collect. Czech. Chem. Commun., vol. 56, (1991) pp. 1253–1262.

S. Brunauer, et al., "Adsorption of Gases in Multimolecular Layers", J. Amer. Chem. Soc., vol. 60, (1938) pp. 309–319.

E.P. Barrett, et la., "The Determination of Pore Volume and Area Distribution in Porous Substances. I.Computations from Nitrogen Isotherms",J. Amer. Chem. Soc., vol. 73, (1951) pp. 373–380.

* cited by examiner

*Primary Examiner*—Pamela R. Schwartz
(74) *Attorney, Agent, or Firm*—Fitzpatrick, Cella, Harper & Scinto

(57) ABSTRACT

Disclosed herein is a recording medium for ink-jet, comprising a substrate composed of kenaf paper, and an ink-receiving layer provided on the substrate, wherein the ink-receiving layer comprises an alumina hydrate, a compound represented by the general formula (I)

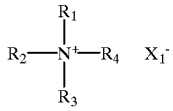

wherein $R_1$, $R_2$, $R_3$ and $R_4$ are, independently of one another, a substituted or unsubstituted alkyl group, and $X_1^-$ is an anion of a fluoride, chloride, bromide, iodide, astatide, sulfate, alkoxylsulfate, sulfite, phosphate, phosphite, perchlorate, perbromate, periodate or chlorate, and a compound represented by the general formula (II)

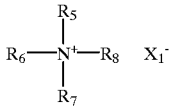

wherein $R_5$, $R_6$, $R_7$ and $R_8$ are, independently of one another, a substituted or unsubstituted alkyl group except that at least one of $R_5$, $R_6$, $R_7$ and $R_8$ is a substituted or unsubstituted aryl or arylalkyl group, and $X_1^-$ is an anion of a fluoride, chloride, bromide, iodide, astatide, sulfate, alkoxylsulfate, sulfite, phosphate, phosphite, perchlorate, perbromate, periodate or chlorate.

15 Claims, No Drawings

RECORDING MEDIUM FOR INK-JET

BACKGROUND OF THE INVENTION

1. Field of the Invention

The present invention relates to recording media for ink-jet using kenaf paper as a substrate, and particularly to recording media for ink-jet, which can provide images having excellent water fastness.

2. Related Background Art

An ink-jet recording system is a system wherein minute droplets of an ink are ejected by any one of various working principles to apply them to a recording medium such as paper, thereby making a record of images, characters and/or the like, and is being quickly spread in various applications, for example, recording of various graphics including characters, and color images, and so on, because it has features that recording can be conducted at high speed and with a low noise, color images can be formed with ease, recording patterns are very flexible, and developing and fixing treatment are unnecessary.

Recording media used for such a recording system have come to be required to provide images having good water fastness in addition to ink absorption at high speed, high ink absorbing capacity, and the provision of images high in optical density and improved in image quality.

In order to satisfy such requirements, Japanese Patent Application Laid-Open No. 55-51583 discloses that a coating layer composed of amorphous silica and a polymer binder has good ink absorbency in printing with water-based inks and is hence suitable for use in high-density printing. With respect to recording media for ink-jet, which can provide images having good water fastness, the use of modified polyvinyl alcohol containing a silyl group is disclosed in Japanese Patent Application Laid-Open No. 10 61-134290, the use of a polycationic polymeric electrolyte in Japanese Patent Application Laid-Open No. 56-84992, a method of using a polyvalent metal salt in Japanese Patent Application Laid-Open No. 56-86789, a method of using at least one water-soluble metal salt having a divalent or still higher ionic valence and a cationic organic substance in Japanese Patent Application Laid-Open No. 60-67190, and a method of using silanol group-containing polyvinyl alcohol and a zirconium compound in Japanese Patent Application Laid-Open No. 6-32046. Further, Japanese Patent Application Laid-Open No. 7-1833 discloses a method of using a monoammonium compound as a water-proofing agent.

These known compounds and methods satisfy their intended ends, but still require improvement. From the viewpoint of, for example, improvement in the water fastness of images, it has been known that the addition of a cationic substance permits the improvement of the water fastness due to its ionic bonding to an anionic dye. However, in all the known recording media, they are only evaluated as to optical density by dipping the whole surfaces of prints in water to observe whether inks of the prints are redissolved out in water or not. From the viewpoint of practical use, a case where water is applied to a part of a print often occurs rather than a case where the whole surface of a print is dipped in water. In this case, bleeding at boundaries between a portion with which water has come into contact and a portion in no contact with water becomes a problem. In particular, even when inks are not redissolved out when the whole surface of a print is dipped in water, the bleeding may be observed in some cases when the print is brought into partial contact with water and dried. This is considered to be due to the fact that since penetration of water into a substrate proceeds over a longer period of time in the case of the partial contact with water compared with the case of the dipping in water, the bleeding of the print more markedly appears.

On the other hand, in the case where the coating layer composed of the amorphous silica and the polymer binder is formed on the surface of paper, the resulting recording medium is accompanied by many problems. For example, since the surface of paper is covered with the amorphous silica, the natural hand and feeling of paper is impaired, the surface thereof becomes powdery, and dusting occurs when it is folded or conveyed.

SUMMARY OF THE INVENTION

With the foregoing circumstances in view, it is an object of the present invention to provide a recording medium for ink-jet, which can provide images having good image quality and excellent water fastness by a printer of the ink-jet system, and retains the natural hand and feeling of a paper substrate as it is.

The above object can be achieved by the present invention described below.

According to the present invention, there is thus provided a recording medium for ink-jet, comprising a substrate composed of kenaf paper, and an ink-receiving layer provided on the substrate, wherein the ink-receiving layer comprises an alumina hydrate, a compound represented by the general formula (I)

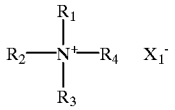

wherein $R_1$, $R_2$, $R_3$ and $R_4$ are, independently of one another, a substituted or unsubstituted alkyl group, and $X_1^-$ is an anion of a fluoride, chloride, bromide, iodide, astatide, sulfate, alkoxylsulfate, sulfite, phosphate, phosphite, perchlorate, perbromate, periodate or chlorate, and a compound represented by the general formula (II)

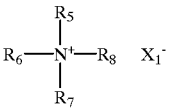

wherein $R_5$, $R_6$, $R_7$ and $R_8$ are, independently of one another, a substituted or unsubstituted alkyl group except that at least one of $R_5$, $R_6$, $R_7$ and $R_8$ is a substituted or unsubstituted aryl or arylalkyl group, and $X_1^-$ is an anion of a fluoride, chloride, bromide, iodide, astatide, sulfate, alkoxylsulfate, sulfite, phosphate, phosphite, perchlorate, perbromate, periodate or chlorate.

According to the present invention, there is also provided a recording medium for ink-jet, comprising a substrate composed of kenaf paper, and an ink-receiving layer provided on the substrate, wherein the ink-receiving layer comprises an alumina hydrate, benzethonium chloride and a polyallylamine derivative represented by the general formula (III)

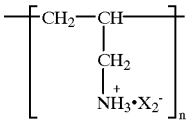

wherein $X_2^-$ is $Br^-$, $Cl^-$, $I^-$, $HOSO_3^-$, $CH_3OSO_3^-$ or $C_2H_5OSO_3^-$, and n is an integer of from 5 to 10,000.

According to the present invention, there is further provided a recording medium for ink-jet, comprising a substrate composed of kenaf paper, and an ink-receiving layer provided on the substrate, wherein the ink-receiving layer comprises an alumina hydrate, benzethonium chloride and a compound represented by the general formula (IV)

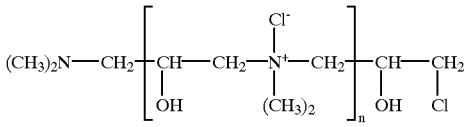

wherein n is an integer of from 10 to 30,000.

DESCRIPTION OF THE PREFERRED EMBODIMENTS

The recording media for ink-jet according to the present invention each have an ink-receiving layer, which can provide an image having excellent water fastness, on a substrate composed of kenaf paper.

The kenaf paper is paper which is soft and gives an impression of high grade, and attracts attention at present. For example, Japanese Patent Application Laid-Open Nos. 2-88286 and 2-92576 have proposed, as their objects, that a base paper web for thermal recording paper and pressure sensitive paper is provided by using kenaf pulp in combination with ordinary pulp. Japanese Patent Application Laid-Open No. 6-262868 has proposed, as its object, that paper for receiving thermal transfer printing is provided.

According to the recording media for ink-jet according to the present invention, the quality of an image formed thereon can be enhanced by using kenaf paper as a substrate.

The kenaf paper preferably contains kenaf pulp and wood pulp at a weight ratio of from 50:50 to 100:0.

The thickness and basis weight of the kenaf paper are preferably within ranges of from 10 to 200 $\mu$m and from 10 to 200 g/m$^2$, respectively. In order to form an ink-receiving layer which can provide an image having good water fastness, the Stöckigt sizing degree of the kenaf paper is also limited to a suitable range. Namely, the Stöckigt sizing degree is preferably within a range of from 50 seconds to 200 seconds based on the basis weight of 127 g/m$^2$.

The ink-receiving layer according to the present invention permits the formation of an image having excellent water fastness when the image is formed thereon.

The ink-receiving layer according to the present invention includes ink-receiving layers of the following three types:

(A) An ink-receiving layer comprising an alumina hydrate, a compound represented by the general formula (I)

(I)

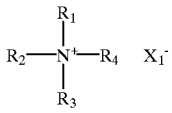

wherein $R_1$, $R_2$, $R_3$ and $R_4$ are, independently of one another, a substituted or unsubstituted alkyl group, and $X_1^-$ is an anion of a fluoride, chloride, bromide, iodide, astatide, sulfate, alkoxylsulfate, sulfite, phosphate, phosphate, perchlorate, perbromate, periodate or chlorate, and a compound represented by the general formula (II)

(II)

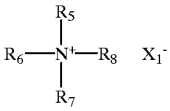

wherein $R_5$, $R_6$, $R_7$ and $R_8$ are, independently of one another, a substituted or unsubstituted alkyl group except that at least one of $R_5$, $R_6$, $R_7$ and $R_8$ is a substituted or unsubstituted aryl or arylalkyl group, and $X_1^-$ is an anion of a fluoride, chloride, bromide, iodide, astatide, sulfate, alkoxylsulfate, sulfite, phosphate, phosphate, perchlorate, perbromate, periodate or chlorate;

(B) An ink-receiving layer comprising an alumina hydrate, benzethonium chloride and a polyallylamine derivative represented by the general formula (III)

(III)

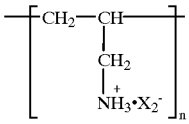

wherein $X_2^-$ is $Br^-$, $Cl^-$, $I^-$, $HOSO_3^-$, $CH_3OSO_3^-$ or $C_2H_5OSO_3^-$, and n is an integer of from 5 to 10,000; and (C) An ink-receiving layer comprising an alumina hydrate, benzethonium chloride and a compound represented by the general formula (IV)

(IV)

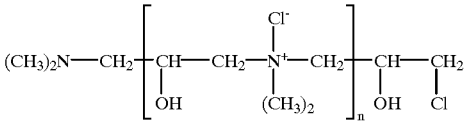

wherein n is an integer of from 10 to 30,000, and benzethonium chloride.

Any of the above-described ink-receiving layers can impart excellent water fastness to an image formed thereon.

In the ink-receiving layer (A), the alumina hydrate is preferably contained in a proportion of from 20 to 60% by weight based on the ink-receiving layer. The compound represented by the general formula (I) is preferably contained in a proportion of from 12 to 55% by weight based on the ink-receiving layer. The compound represented by the general formula (II) is preferably contained in a proportion of from 8 to 45% by weight based on the ink-receiving layer.

In the ink-receiving layer (B), the alumina hydrate is preferably contained in a proportion of from 30 to 60% by weight based on the ink-receiving layer. The compound represented by the general formula (III) is preferably contained in a proportion of from 12 to 45% by weight based on the ink-receiving layer. Benzethonium chloride is preferably contained in a proportion of from 10 to 45% by weight based on the ink-receiving layer.

In the ink-receiving layer (C), the alumina hydrate is preferably contained in a proportion of from 20 to 55% by weight based on the ink-receiving layer. The compound represented by the general formula (IV) is preferably contained in a proportion of from 15 to 55% by weight based on the ink-receiving layer. Benzethonium chloride is preferably contained in a proportion of from 8 to 40% by weight based on the ink-receiving layer.

In the ammonium compound of the structural formula represented by the general formula (I), examples of the unsubstituted alkyl group include methyl, ethyl, propyl, octyl, nonyl, behenyl, isopropyl, t-butyl, isobutyl and pentyl. Examples of substituents thereof include halogen atoms, and amino, carboxyl, amide, ammonium, hydroxyl, nitro, alkoxyl, cyano, acyl, acylamide, ether, ester, silyl, aldehyde, ketone, acetyl, acetylamino, acetamide and acetonyl groups.

In the ammonium compound of the structural formula represented by the general formula (II), examples of the unsubstituted aryl group include phenyl, naphthyl, anthryl, tolyl and xylyl. Examples of substituents thereof include halogen atoms, and amino, carboxyl, amide, ammonium, hydroxyl, nitro, alkoxyl, cyano, acyl, acylamide, ether, ester, silyl, aldehyde, ketone, acetyl, acetylamino, acetamide, acetonyl, anilino, isophthaloyl, salicyl and salicyloyl groups. Examples of the arylalkyl group include benzyl, phenethyl, phenylpropyl, benzhydryl (diphenylmethyl) and the like.

In the general formula (II), at least one of $R_5$, $R_6$, $R_7$ and $R_8$ is a substituted or unsubstituted aryl or arylalkyl group, and the remaining groups are linear or branched alkyl or substituted alkyl groups. Examples of the alkyl groups include methyl, ethyl, propyl, octyl, nonyl, behenyl, isopropyl, t-butyl, isobutyl and pentyl. Examples of the substituted alkyl groups include the above-mentioned alkyl groups having any of substituents such as halogen atoms, and amino, carboxyl, amide, ammonium, hydroxyl, nitro, alkoxyl, cyano, acyl, acylamide, ether, ester, silyl, aldehyde, ketone, acetyl, acetylamino, acetamide and acetonyl groups.

The alumina hydrate contained in the ink-receiving layers (A) to (C) is preferably obtained from the so-called amorphous alumina hydrates having a non-crystalline form from the viewpoint of X-ray diffractometry. In particular, the amorphous alumina hydrate preferably used in the present invention initially has a particle size of from 20 to 30 angstroms and a composition of $Al_2O_3 \cdot 3H_2O$, is chemically unstable to generate Cα amorphous gel which is easily soluble in an acid or alkali, and is converted into Cβ gel in a neutral or weakly alkaline, aqueous solution and/or by heating. This cβ gel is called boehmite gel and is considered to have a composition of $Al_2O_3 \cdot 1.0–2.0H_2O$. This is clearly different from crystalline boehmite. Its X-ray diffraction pattern shows a half breadth greater than the crystalline boehmite, and the gel is called pseudo-boehmite. The pseudo-boehmite is a compound having low crystallinity, and its composition is considered to be $Al_2O_3 \cdot xH_2O$ ($1.0 < x < 2.0$) by Rocek, et al. [Collect Czech. Chem. Commun., Vol. 56, 1253–1262 (1991)].

The reason why this pseudo-boehmite has high ink receptivity is considered to be attributable to the fact that the pore radius and pore radius distribution thereof fall within ranges very suitable for ink reception. The pore radius distribution of the pseudo-boehmite has at least two peaks. The pseudo-boehmite absorbs a solvent component in an ink in its comparatively great pores and adsorbs a dye in the ink in its comparatively small pores. The pore radius corresponding to one of the peaks on the pore radius distribution of the pseudo-boehmite is preferably smaller than 100 angstroms, more preferably 10 to 60 angstroms. The pore radius corresponding to another peak is preferably within a range of from 100 to 200 angstroms.

The recording media using these alumina hydrates have advantages that since the alumina hydrates have a positive charge, a dye having a negative charge in an ink is well fixed thereto, and an image good in coloring is hence provided, that there are no problems of bronzing of a black ink and light fastness, which have heretofore been caused by the use of silica compounds, and besides that they provide images, in particular, full-color images, having better quality than those formed on the conventional recording media.

The BET specific surface area of the alumina hydrate, and the pore radius distributions, pore volumes and isothermal nitrogen adsorption and desorption curves of the alumina hydrate and the resulting ink-receiving layer can be determined at the same time by the nitrogen adsorption and desorption method. In the present invention, an alumina hydrate sample or a recording medium sample in which an ink-receiving layer had been formed on a PET film was thoroughly heated and deaerated, and measurement was then conducted by means of an Autosorb 1 manufactured by Quanthachrome Co. The BET specific surface area was calculated in accordance with the method of Brunauer, et al. [J. Am. Chem. Soc., Vol. 60, 309 (1938)]. The pore radius and pore volume were calculated in accordance with the method of Barrett, et al. [J. Am. Chem. Soc., Vol. 73, 373 (1951)].

The BET specific surface area of the alumina hydrate used in the present invention may preferably be within a range of from 37 to 300 $m^2/g$. If the BET specific surface area is greater than the upper limit of the above range, the pore radius distribution is partial to a large side. As a result, a dye in an ink cannot be fully adsorbed and fixed. On the other hand, specific surface areas smaller than the lower limit of the above range result in a failure to apply the pigment with good dispersibility and hence in difficulty in controlling the pore radius distribution. The BET pore volume of the alumina hydrate is preferably within a range of from 0.2 to 0.9 ml/g. If the BET pore volume is smaller than the lower limit of the above range, the resulting recording medium is deteriorated in ink absorbency. If the BET pore volume is greater than the upper limit of the above range, the resulting ink-receiving layer tends to cause dusting.

As the alumina hydrate used in the present invention, those containing a metal oxide, for example, titanium dioxide, may also be used. The use of such alumina hydrate permits a further improvement in both properties of dispersibility and adsorptiveness of a dye in an ink, which have heretofore been difficult to achieve, compared with the conventional alumina hydrate.

The content of titanium dioxide is preferably within a range of from 0.01 to 1.00% by weight, more preferably from 0.13 to 1.00% by weight based on the alumina hydrate. Further, the valence of titanium in the titanium dioxide is preferably +4.

The contents of the alumina hydrate, which are necessary and sufficient for coating formulations according to the present invention, are preferably as follows. In the coating formulation for the ink-receiving layer (A), the content is within a range of from 0.5 to 11.0% by weight in terms of the concentration of an available component. In the coating formulation for the ink-receiving layer (B) using the polyallylamine derivative as a water-proofing agent, the content is within a range of from 3 to 11.0% by weight. In the coating formulation for the ink-receiving layer (C) using the quaternary ammonium salt type water-soluble resin as a water-proofing agent, the content is within a range of from 0.5 to 11.0% by weight. If the content of the alumina hydrate in each coating formulation is lower than the lower limit of the above range, a recording medium coated with such a coating formulation has insufficient ink absorbency, and so an image formed thereon becomes poor in coloring. If the content is higher than the upper limit of the above range, the viscosity of the coating formulation is increased, so that there is a tendency to fail to uniformly apply a small amount of such a coating formulation.

Other white pigments may be used in combination according to the ink-jet suitability (coloring ability, resolution, water fastness, light fastness, etc.) of paper. Examples of these white pigments include pigments generally used for paper coating, such as silica, zeolite, calcium carbonate, diatomaceous earth, kaolin clay, calcined clay, talc, aluminum hydroxide, colloidal alumina, alumina, barium sulfate, titanium dioxide, zinc oxide, zinc carbonate, magnesium silicate, magnesium carbonate and organic pigments (plastic pigments). These pigments must be dispersed in water for them to be used in a coating formulation. For this purpose, it is preferred to add a commonly used dispersing agent such as sodium polyacrylate, a phosphate or a surfactant.

The polyallylamine derivative and benzethonium chloride are used as a water-proofing agent which is a component for forming the ink-receiving layer (B). The polyallylamine derivatives represented by the general formula (III) in the present invention include those obtained in the form of a hydrochloride through, for example, the following process, and besides neutralized products thereof and copolymers of monoallylamine and diallylamine. Specifically, they are available from Nitto Boseki Co., Ltd. under the trade names of PAA-15, PAA-15B, PAA-10C, PAA-HCl-3L, PAA-HCl-10L, PAA-HCl-3S, PAA-HCl-10S and PAA-11D-HCl.

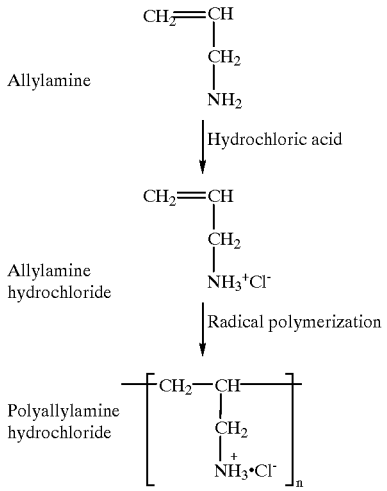

In the ink-receiving layer (C), the quaternary ammonium salt type water-soluble resin represented by the general formula (IV) and benzethonium chloride are used as a water-proofing agent which is a component for forming the ink-receiving layer. The quaternary ammonium salt type water-soluble resin represented by the general formula (IV) is available from Nagase Chemicals, Ltd. under the trade name of WEISSTEX.

The excellent water fastness of image, which is brought about by the ammonium compound, polyallylamine derivative or quaternary ammonium salt type water-soluble resin in the present invention is considered to be developed by the following action.

When water is dropped on a recording surface, waterdrops gradually penetrate into the interior of a substrate or diffuse into the surface thereof. At this time, the travel speed of the water is determined by the kind of the coating formulation on the substrate, the kind, Stockigt sizing degree and smoothness of the substrate, and the like. However, right after the dropping, the travel speed is comparatively as high as about 1 mm/sec to 30 mm/sec. Before long, the travel speed becomes as low as less than 1 mm/sec, and the travel time takes a long time until the water starts to substantially dry. As the travel time of the water becomes longer, a dye in an ink in the substrate or the ink-receiving layer is more dissolved out by the osmotic pressure of the water dropped, and appears as bleeding.

The reason why the water fastness against the dropped water is enhanced by adding the respective compounds to the ink-receiving layers in the above-described combinations is not clearly understood. However, it is considered that the force of the alkyl moiety of each compound to adsorb on the substrate or pigment and the force of the ammonia moiety bonded to the dye molecule by Coulomb force are greater than the osmotic pressure of the water dropped, and so the occurrence of bleeding of the dye is prevented. Since the effect of accelerating the travel speed of the dropped water is also developed, this effect also is considered to contribute to the enhancement of the water fastness. It goes without saying that the physical properties of silica, binder and/or the like, which may be used in combination in the coating formulation in some cases, also affect the performance of water fastness.

In the coating formulation for the ink-receiving layer (A), the content of the ammonium compound represented by the general formula (I) is within a range of from 1 to 8% by weight in terms of the concentration of an available component. If the content is lower than 1% by weight, the effect of enhancing the water fastness is not brought about. If the content exceeds 8% by weight, there are tendencies to lower the water fastness to the contrary, and to increase the viscosity of the resulting coating formulation. In the coating formulation for the ink-receiving layer (B), the content of the polyallylamine derivative is within a range of from 1 to 8% by weight. If the content is lower than 1 % by weight, the effect of enhancing the water fastness is not brought about. If the content exceeds 8% by weight, there are tendencies to lower the water fastness to the contrary, and to increase the viscosity of the resulting coating formulation. In the coating formulation for the ink-receiving layer (C), the content of the quaternary ammonium salt type water-soluble resin is within a range of from 1 to 6% by weight. If the content is lower than 1% by weight, the effect of enhancing the water fastness is not brought about. If the content exceeds 6% by weight, there are tendencies to lower the water fastness to the contrary, and to increase the viscosity of the resulting coating formulation.

The benzethonium chloride is represented by the formula (V)

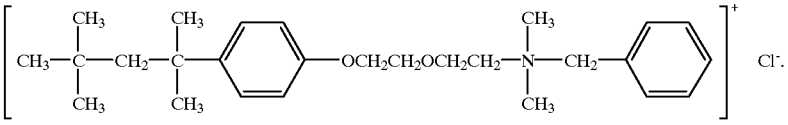

Hyamine 1622 (product of Sankyo Chemical Industries, Ltd., Rhemerol (product of Parke Davis Co.), etc. are known as marketed products.

The reason why the benzethonium chloride is used in combination with the water-proofing agent is that since the benzethonium chloride itself has a quaternary ammonium group, the effect of preventing the bleeding of a dye is enhanced for the same reason as described above, and besides its surface active effect is utilized. Namely, the benzethonium chloride can serve to lower the surface energy of the coating formulation, thereby facilitating the uniform coating of the surface of kenaf paper as the substrate with the coating formulation and causing the alumina hydrate to penetrate between pulp fibers.

In the coating formulation for the ink-receiving layer (B), the content of the benzethonium chloride is within a range of from 1 to 7% by weight in terms of the concentration of an available component. If the content is lower than 1% by weight, the effect of enhancing the water fastness is not brought about. If the content exceeds 7% by weight, there are tendencies to lower the water fastness to the contrary, and to increase the viscosity of the resulting coating formulation. In the coating formulation for the ink-receiving layer (C), the content of the benzethonium chloride is within a range of from 0.5 to 5.0% by weight. If the content is lower than 1% by weight, the effect of enhancing the water fastness is not brought about. If the content exceeds 5.0% by weight, the water fastness tends to be lowered to the contrary.

In the ink-receiving layer (A), the ammonium compound represented by the general formula (II) is used in combination as a water-proofing agent. The reason why the ammonium compound represented by the general formula (II) is used as the water-proofing agent in combination is that although the effect of the ammonium compound represented by the general formula (I) to enhance the water fastness is developed when the recording surface of the resulting recording medium is dipped in water, its effect of enhancing the water fastness when water is dropped on the recording surface is insufficient, and so the ammonium compound represented by the general formula (II) is used in combination for the purpose of compensating for this insufficiency.

The content of the ammonium compound represented by the general formula (II) in the coating formulation is within a range of from 0.5 to 7.0% by weight in terms of the concentration of an available component. If the content is lower than 0.5% by weight, the effect of enhancing the water fastness is not brought about. If the content exceeds 7.0% by weight, there are tendencies to lower the water fastness to the contrary, and to increase the viscosity of the resulting coating formulation.

Since the recording media for ink-jet according to the present invention use, as a pigment, an alumina hydrate which easily penetrates into the surface of a paper substrate, the natural hand and feeding of the paper substrate is retained as it is, and no problems such as dusting on the surfaces of the media arise upon usual use.

When other pigments than the alumina hydrate are mixed in the coating formulations, or the surface smoothness and smooth writing quality are additionally required, a binder may be added to the coating formulations. Preferable examples of the binder include hydrophilic binders, such as polyvinyl alcohol, modified polyvinyl alcohol, polyacrylamide, polyvinyl acetate, oxidized starch, etherified starch, cellulose derivatives such as carboxymethyl cellulose and hydroxyethyl cellulose, casein, gelatin, soybean protein, maleic anhydride resins, conjugated diene type copolymer latexes such as styrene-butadiene copolymers and methyl methacrylate-butadiene copolymers, acrylic polymer latexes such as polymers of acrylic esters and methacrylic esters or copolymers thereof, vinyl polymer latexes such as ethylene-vinyl acetate copolymers, functional group-modified polymer latexes of these various polymers with a monomer containing a functional group such as a carboxyl group, and thermosetting synthetic resins such as melamine resins and urea resins; and synthetic resin binders such as polymethyl methacrylate, polyurethane resins, unsaturated polyester resins, vinyl chloride-vinyl acetate copolymers, polyvinyl butyral and alkyd resins. These binders may be used either singly or in any combination thereof. Among these, water-soluble polymer binders are preferably used in the present invention.

Surfactants may be used in the ink-receiving layers according to the present invention. Examples thereof include anionic surfactants such as carboxylates, sulfonates, salts of sulfuric esters and salts of phosphoric esters; cationic surfactants such as aliphatic amine salts, aliphatic quaternary ammonium salts, aromatic quaternary ammonium salts and heterocyclic quaternary ammonium salts; nonionic surfactants, such as ether types such as polyoxyethylene alkyl ethers, polyoxyethylene alkyl phenyl ethers and polyoxyethylene-polyoxypropylene block polymers, ether ester types such as polyoxyethylene glycerol fatty acid esters and polyoxyethylene sorbitan fatty acid esters, ester types such as polyoxyethylene glycol fatty acid esters, sorbitan fatty acid esters and sucrose fatty acid esters, and nitrogen-containing types such as polyoxyethylene fatty acid amides and polyoxyethylene alkylamines; and amphoteric surfactants such as betaines, aminocarboxylates and imidazoline derivatives.

In the ink-receiving layers according to the present invention, there may be suitably incorporated other additives such as pigment dispersants, thickeners, flowability modifiers, antifoaming agents, foam-inhibitors, parting agents, foaming agents, penetrants, coloring dyes, optical whitening agents, ultraviolet absorbents, antioxidants, antiseptics, mildewproofing agents, monomers, polymers, ink-setting agents and chelating agents.

The coating formulations of the present inventions thus obtained are each applied to form an ink-receiving layer on a substrate in a proportion of from 1 to 15 $g/m^2$ in terms of solids. Any proportion lower than 1 $g/m^2$ results in a recording medium which provides an image deteriorated in optical density, image quality and water fastness. On the other hand, any proportion exceeding 15 $g/m^2$ results in a recording medium which tends to separate the resulting ink-receiving layer.

The coating formulations according to the present invention are each prepared by uniformly dispersing or dissolving the above-described components by a method known per se in the art. As a method for dispersing the components, it is preferred to use a dispersing machine such as a ball mill, attritor, sand mill, homomixer, Microfluidizer (manufactured by Microfluidex Co.) or Nanomizer (manufactured by Nanomizer Co.).

The viscosity of each of the coating formulations may be changed according to a coating method, coating device, coating weight and substrate. However, it is generally preferred that the viscosity be from 80 cP to 1,000 cP. If the viscosity is lower than 80 cP, it is difficult to apply the coating formulation so as to give a predetermined coating weight. If the viscosity is higher than 1,000 cP, the coated surface becomes uneven. It is hence not preferred to use any coating formulation having such a low or high viscosity.

As a process for producing the recording media for ink-jet according to the present invention, the above-described substrate is provided, and any of the coating formulations is then applied to the substrate by means of a coater or size press to provide at least one ink-receiving layer thereon. A coating method may be either on-machine coating or off-machine coating, and any conventionally known coater such as an air knife coater, die coater, blade coater, gate roll coater, bar coater, rod coater, roll coater, gravure coater or curtain coater may be used. After the coating, the coating formulation is dried by blowing hot air against the coated surface. The temperature and air flow of the hot air may vary according to the kinds of the substrate and coating formulation used. However, the temperature is preferably from 70° C. to 160° C. If the temperature is lower than 70° C., it takes a longer time to dry the coating formulation. If the temperature is higher than 160°C., the substrate and coating formulation undergo denaturation. It is hence not preferred to dry the coating formulation at such a low or high temperature.

After the coating, the resulting recording medium may be further subjected to calendering by means of a machine calender, supercalender, soft calender or the like to finish it.

In the present invention, a backcoat layer may be provided on a surface opposite to the coated surface of the substrate. The formulation of the backcoat layer may be the same or different from the formulation of the ink-receiving layer, and no particular limitation is imposed on the coating weight, coating method and the like thereof.

In the present invention, inks are a sort of recording material composed of the following coloring material and liquid medium, and other additives. Examples of the coloring material include water-soluble dyes such as direct dyes, acid dyes, basic dyes, reactive dyes and food colors. As the liquid medium, water and various kinds of water-soluble organic solvents may be used.

The present invention will hereinafter be described more specifically by the following Examples. However, it goes without saying that the present invention is not limited to these examples.

Preparation Example of Substrate

Substrates were prepared or provided in the following manner. Incidentally, the measurement of Stockigt sizing degree was conducted in accordance with the method described in JIS P 8122.

Substrate A:

Kenaf paper (Kenaf GA Field, trade name, product of Mishima Paper Co., Ltd.; content of kenaf pulp: 70%) having a basis weight of 127 g/m$^2$. The Stöckigt sizing degree thereof was 50 seconds.

Substrate B:

Kenaf paper (Kenaf 100, trade name, product of Mishima Paper Co., Ltd.; content of kenaf pulp: 100%) having a basis weight of 127 g/m$^2$. The Stöckigt sizing degree thereof was 190 seconds.

Preparation of Coating Formulation A

Sixty grams of an alumina hydrate (a product described in Example A of Japanese Patent Application Laid-Open No. 7-89221; BET specific surface area: 76 m$^2$/g; BET pore volume: 0.57 ml/g) were fed into 240 g of ion-exchanged water, the mixture was stirred for 30 minutes by a stirrer and then dispersed for 30 minutes at 8,000 rpm by a homomixer to obtain an alumina slurry. To the slurry of 90 g weighed, 80 g of dodecyltrimethyl-ammonium chloride (Cation BB-300, trade name, product of Nippon Oil & Fats Co., Ltd.), 18 g of benzalkonium chloride (Cation 08B, trade name, product of Morin Chemical Industries, Ltd.) and 130 g of ion-exchanged water were added. The mixture was stirred for 30 minutes by a three-one motor to prepare Coating Formulation A. The viscosity of the coating formulation thus prepared was 960 cP (as measured at 30 rpm and 25° C. by a Brookfield rotational viscometer HM-2).

Preparation of Coating Formulation B

Sixty grams of an alumina hydrate (a product described in Example A of Japanese Patent Application Laid-Open No. 7-89221; BET specific surface area: 76 m$^2$/g; BET pore volume: 0.57 ml/g) were fed into 240 g of ion-exchanged water, and the mixture was stirred for 30 minutes by a stirrer and then dispersed for 30 minutes at 8,000 rpm by a homomixer to obtain an alumina slurry. To the slurry of 90 g weighed, 70 g of behenyltrimethyl-ammonium chloride (Cation BV, trade name, product of Nippon Oil & Fats Co., Ltd.), 22 g of benzalkonium chloride (Cation 24B-P, trade name, product of Morin Chemical Industries, Ltd.) and 130 g of ion-exchanged water were added. The mixture was stirred for 30 minutes by a three-one motor to prepare Coating Formulation B. The viscosity of the coating formulation thus prepared was 1,120 cP (as measured at 30 rpm and 25° C. by a Brookfield rotational viscometer HM-2).

Preparation of Coating Formulation C

Sixty grams of an alumina hydrate (a product described in Example A of Japanese Patent Application Laid-Open No. 7-89221; BET specific surface area: 76 m$^2$/g; BET pore volume: 0.57 ml/g) were fed into 240 g of ion-exchanged water, and the mixture was stirred for 30 minutes by a stirrer and then dispersed for 30 minutes at 8,000 rpm by a homomixer to obtain an alumina slurry. To the slurry of 90 g weighed, 80 g of a polyallylamine derivative (PAA-15B, trade name, product of Nitto Boseki Co., Ltd.; concentration of available component: 15%), 9 g of benzethonium chloride (Hyamine 1622, trade name, product of Sankyo Chemical Industries, Ltd.; concentration of available component: 100%) and 121 g of ion-exchanged water were added. The mixture was stirred for 30 minutes by a three-one motor to prepare Coating Formulation C. The viscosity of the coating formulation thus prepared was 1,450 cP (as measured at 30 rpm and 25° C. by a Brookfield rotational viscometer HM-3).

Preparation of Coating Formulation D

To 90 g of the alumina slurry prepared in Coating Formulation A weighed, 120 g of a polyallylamine derivative (PAA-10C, trade name, product of Nitto Boseki Co., Ltd.; concentration of available component: 10%), 12 g of benzethonium chloride (Hyamine 1622, trade name, product of Sankyo Chemical Industries, Ltd.; concentration of available component: 100%) and 78 g of ion-exchanged water were added. The mixture was stirred for 30 minutes by a three-one motor to prepare Coating Formulation D. The viscosity of the coating formulation thus prepared was 670 cP (as measured at 30 rpm and 25° C. by a Brookfield rotational viscometer HM-3).

Preparation of Coating Formulation E

To 45 g of the alumina slurry prepared in Coating Formulation A weighed, 20 g of a quaternary ammonium salt type water-soluble resin (WEISSTEX H-90, trade name, product of Nagase Chemicals, Ltd.; concentration of available component: 100%), 6 g of benzethonium chloride (Hyamine 1622, trade name, product of Sankyo Chemical Industries, Ltd.; concentration of available component: 100%), 1.5 g of a silicon type antifoaming agent (FS Antifoam 91, trade name, product of Dow Corning Co.; concentration of available component: 16%) and 229 g of ion-exchanged water were added. The mixture was stirred for 30 minutes by a three-one motor to prepare Coating Formulation E. The viscosity of the coating formulation thus prepared was 330 cP (as measured at 30 rpm and 25° C. by a Brookfield rotational viscometer HM-2).

Preparation of Coating Formulation F

Sixty grams of an alumina hydrate (BET specific surface area: 45 $m^2/g$; BET pore volume: 0.48 ml/g) were fed into 240 g of ion-exchanged water, the mixture was stirred for 30 minutes by a stirrer and then dispersed for 30 minutes at 8,000 rpm by a homomixer to obtain an alumina slurry. After 90 g of this slurry was weighed out, the procedure in Coating Formulation A was followed to prepare Coating Formulation F. The viscosity of the coating formulation thus prepared was 790 cP (as measured at 30 rpm and 25° C. by a Brookfield rotational viscometer HM-2).

Preparation of Coating Formulation G

Sixty grams of an alumina hydrate (BET specific surface area: 284 $m^2/g$; BET pore volume: 0.24 ml/g) were fed into 240 g of ion-exchanged water, the mixture was stirred for 30 minutes by a stirrer and then dispersed for 30 minutes at 8,000 rpm by a homomixer to obtain an alumina slurry. After 90 g of this slurry was weighed out, the procedure in Coating Formulation A was followed to prepare Coating Formulation G. The viscosity of the coating formulation thus prepared was 370 cP (as measured at 30 rpm and 25° C. by a Brookfield rotational viscometer HM-2).

Preparation of Coating Formulation H

Sixty grams of an alumina hydrate (BET specific surface area: 184 $m^2/g$; BET pore volume: 0.87 ml/g) were fed into 240 g of ion-exchanged water, the mixture was stirred for 30 minutes by a stirrer and then dispersed for 30 minutes at 8,000 rpm by a homomixer to obtain an alumina slurry. After 90 g of this slurry was weighed out, the procedure in Coating Formulation A was followed to prepare Coating Formulation H. The viscosity of the coating formulation thus prepared was 1,100 cP (as measured at 30 rpm and 25° C. by a Brookfield rotational viscometer HM-2).

EXAMPLES 1 to 16

One side of each the above-described substrates A and B was coated with the coating formulations A to H prepared above, respectively, according to the corresponding combinations shown in Table 1 to produce recording media according to the present invention.

Coating method: air knife coating;

Coating weight: shown in Table 1;

Drying temperature: 100° C. with hot air;

Drying time: 5 minutes.

The recording media thus produced were evaluated in the following manner.

Recording for Evaluation:

Recording for evaluation was conducted by means of an ink-jet printer (BJ Color Printer BJC-600S, trade name, manufactured by Canon Inc.) Optical density of image:

Optical densities of solid printed areas of yellow (Y), magenta (M), cyan (C) and black (BK) colors were measured by means of a Macbeth reflection densitometer RD-1255.

Image Quality:

A straight line having a width of 1 dot was printed parallel to the scanning direction of a head to visually conduct evaluation as to image quality by observing the straight line from a distance of 25 cm. The sample recording medium was ranked as A where the straight line was visible as a clear straight line, or B or C as the line became more unclear.

Water Fastness:

Water Fastness Upon Dipping in Water:

A sample recording medium on which solid printing had been conducted was dipped for 3 seconds in tap water, taken out of the water and then air dried. After the drying, whether ink running occurred or not was visually confirmed. The sample recording medium was ranked as A where no ink running was observed, or B or C as ink running became more conspicuous.

Water Fastness Upon Dropping of Water:

Nine lines were printed at intervals of 2 mm in the form of a grid pattern within a frame of 2 cm square by the printer, and one drop of tap water was dropped on the center of the frame by a dropping pipette. After air dried, whether distortion or bleeding occurred on the lines in the form of a grid pattern or not was visually confirmed. The sample recording medium was ranked as A where neither distortion nor bleeding was observed, or B or C as distortion or bleeding became more conspicuous.

The evaluation results are shown in Table 1.

TABLE 1

| | substrate | CF*1 | CW*2 | Optical density at solid printed area | | | | Image quality | WF*3 upon dip | WF*4 upon drop |
|---|---|---|---|---|---|---|---|---|---|---|
| | | | | Y | M | C | BK | | | |
| Ex. 1 | A | A | 3.5 | 1.24 | 1.45 | 1.31 | 1.42 | A | A | A |
| Ex. 2 | A | B | 3.8 | 1.20 | 1.43 | 1.29 | 1.46 | A | A | A |

TABLE 1-continued

| | sub-strate | CF*1 | CW*2 | Optical density at solid printed area Y | M | C | BK | Image qua-lity | WF*3 upon dip | WF*4 upon drop |
|---|---|---|---|---|---|---|---|---|---|---|
| Ex. 3 | A | C | 4.3 | 1.07 | 1.38 | 1.24 | 1.39 | A | A | A |
| Ex. 4 | A | D | 4.1 | 1.19 | 1.46 | 1.37 | 1.37 | A | A | A |
| Ex. 5 | A | E | 2.8 | 1.34 | 1.59 | 1.31 | 1.42 | A | A | A |
| Ex. 6 | A | F | 5.6 | 1.09 | 1.36 | 1.29 | 1.35 | A | A | A |
| Ex. 7 | A | G | 6.1 | 1.20 | 1.41 | 1.38 | 1.40 | A | A | A |
| Ex. 8 | A | H | 4.5 | 1.12 | 1.32 | 1.32 | 1.38 | A | A | A |
| Ex. 9 | B | A | 4.1 | 1.18 | 1.39 | 1.37 | 1.43 | A | A | A |
| Ex. 10 | B | B | 3.9 | 1.15 | 1.42 | 1.41 | 1.40 | A | A | A |
| Ex. 11 | B | C | 3.9 | 1.10 | 1.32 | 1.35 | 1.35 | A | A | A |
| Ex. 12 | B | D | 6.8 | 1.14 | 1.41 | 1.44 | 1.34 | A | A | A |
| Ex. 13 | B | E | 3.0 | 1.32 | 1.56 | 1.41 | 1.48 | A | A | A |
| Ex. 14 | B | F | 7.2 | 1.16 | 1.34 | 1.40 | 1.39 | A | A | A |
| Ex. 15 | B | G | 6.0 | 1.22 | 1.42 | 1.36 | 1.40 | A | A | A |
| Ex. 16 | B | H | 4.9 | 1.14 | 1.30 | 1.35 | 1.37 | A | A | A |

*1Coating formulation;
*2Coating weight (g/m$^2$);
*3Water fastness upon dipping in water;
*4Water fastness upon dropping water.

According to the present invention, there can be provided recording media for ink-jet, which can provide images that are good in image quality and excellent in water fastness, particularly, water fastness upon dropping of water, and retain the natural hand and feeling of paper.

What is claimed is:

1. A recording medium for ink-jet, comprising a substrate composed of kenaf paper, and an ink-receiving layer provided on the substrate, wherein the ink-receiving layer comprises an alumina hydrate, a compound represented by the general formula (I)

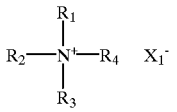

wherein $R_1$, $R_2$, $R_3$ and $R_4$ are, independently of one another, a substituted or unsubstituted alkyl group, and $X_1^-$ is an anion of a fluoride, chloride, bromide, iodide, astatide, sulfate, alkoxylsulfate, sulfite, phosphate, phosphate, perchlorate, perbromate, periodate or chlorate, and a compound represented by the general formula (II)

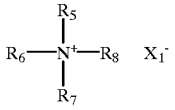

wherein $R_5$, $R_6$, $R_7$ and $R_8$ are, independently of one another, a substituted or unsubstituted alkyl group except that at least one of $R_5$, $R_6$, $R_7$ and $R_8$ is a substituted or unsubstituted aryl or arylalkyl group, and $X_1^-$ is an anion of a fluoride, chloride, bromide, iodide, astatide, sulfate, alkoxylsulfate, sulfite, phosphate, phosphite, perchlorate, perbromate, periodate or chlorate.

2. The recording medium for ink-jet according to claim 1, wherein the kenaf paper contains kenaf pulp and wood pulp at a weight ratio of from 50:50 to 100:0.

3. The recording medium for ink-jet according to claim 1, wherein the content of the alumina hydrate is from 20 to 60% by weight based on the ink-receiving layer.

4. The recording medium for ink-jet according to claim 1, wherein the content of the compound represented by the general formula (I) is from 12 to 55% by weight based on the ink-receiving layer.

5. The recording medium for ink-jet according to claim 1, wherein the content of the compound represented by the general formula (II) is from 8 to 45% by weight based on the ink-receiving layer.

6. A recording medium for ink-jet, comprising a substrate composed of kenaf paper, and an ink-receiving layer provided on the substrate, wherein the ink-receiving layer comprises an alumina hydrate, benzethonium chloride and a polyallylamine derivative represented by the general formula (III)

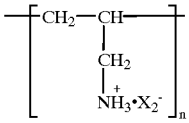

wherein $X_2^-$ is $Br^-$, $Cl^-$, $I^-$, $HOSO_3^-$, $CH_3OSO_3^-$ or $C_2H_5OSO_3^-$, and n is an integer of from 5 to 10,000.

7. The recording medium for ink-jet according to claim 6, wherein the kenaf paper contains kenaf pulp and wood pulp at a weight ratio of from 50:50 to 100:0.

8. The recording medium for ink-jet according to claim 6, wherein the content of the alumina hydrate is from 30 to 60% by weight based on the ink-receiving layer.

9. The recording medium for ink-jet according to claim 6, wherein the content of the compound represented by the general formula (III) is from 12 to 45% by weight based on the ink-receiving layer.

10. The recording medium for ink-jet according to claim 6, wherein the content of the benzethonium chloride is from 10 to 45% by weight based on the ink-receiving layer.

11. A recording medium for ink-jet, comprising a substrate composed of kenaf paper, and an ink-receiving layer provided on the substrate, wherein the ink-receiving layer comprises an alumina hydrate, benzethonium chloride and a compound represented by the general formula (IV)

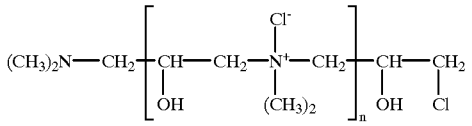

wherein n is an integer of from 10 to 30,000.

12. The recording medium for ink-jet according to claim 11, wherein the kenaf paper contains kenaf pulp and wood pulp at a weight ratio of from 50:50 to 100:0.

13. The recording medium for ink-jet according to claim 11, wherein the content of the alumina hydrate is from 20 to 55% by weight based on the ink-receiving layer.

14. The recording medium for ink-jet according to claim 11, wherein the content of the compound represented by the general formula (IV) is from 15 to 55% by weight based on the ink-receiving layer.

15. The recording medium for ink-jet according to claim 11, wherein the content of the benzethonium chloride is from 8 to 40% by weight based on the ink-receiving layer.

* * * * *

UNITED STATES PATENT AND TRADEMARK OFFICE

CERTIFICATE OF CORRECTION

PATENT NO. : 6,270,881 B1 
DATED : August 7, 2001
INVENTOR(S) : Toshiya Yuasa et al.

It is certified that error appears in the above-identified patent and that said Letters Patent is hereby corrected as shown below:

Title page,
Item [56], References Cited, U.S. PATENT DOCUMENTS,
"Malhotta et al." should read -- Malhotra et al. --.

Column 1,
Line 37, "10" should be deleted.

Column 4,
Lines 12 and 27, "phosphate," (second occurrence) should read -- phosphite, --.
Line 54, "30,000, and benze-" should read -- 30,000. --.
Line 55, should be deleted entirely.

Column 5,
Line 54, "cβ gel" should read -- Cβ gel --.
Line 61, "[Collect" should read -- [Collect. --.

Column 7,
Line 59, "$\overset{+}{N}H_3 \bullet C1^-$" should read -- $NH_3^+ \bullet C1^-$, --.

Column 8,
Line 13, "Stockigt" should read -- Stöckigt --.

Column 9,
Line 11, "Ltd.," should read -- Ltd.), --; and "etc." should read -- etc., --.

Column 14,
Line 26, "Optical" should read -- ¶ Optical --.

UNITED STATES PATENT AND TRADEMARK OFFICE

CERTIFICATE OF CORRECTION

PATENT NO. : 6,270,881 B1 
DATED : August 7, 2001
INVENTOR(S) : Toshiya Yuasa et al.

It is certified that error appears in the above-identified patent and that said Letters Patent is hereby corrected as shown below:

Column 15,
Line 45, "phosphate," (second occurrence) should read -- phosphite, --.

Signed and Sealed this

Twenty-eighth Day of January, 2003

JAMES E. ROGAN
*Director of the United States Patent and Trademark Office*